United States Patent [19]

Greiner

[11] 4,428,287

[45] Jan. 31, 1984

[54] METHOD FOR PRODUCTION OF IMPRESSIONS OF ACCURATE REGISTER ON PRINTING PRESSES

[75] Inventor: Harry M. Greiner, Offenbach am Main, Fed. Rep. of Germany

[73] Assignee: M.A.N.-Roland Druckmaschinen Aktiengesellschaft, Fed. Rep. of Germany

[21] Appl. No.: 417,566

[22] Filed: Sep. 13, 1982

[30] Foreign Application Priority Data

Sep. 16, 1981 [DE] Fed. Rep. of Germany ..... 3136705

[51] Int. Cl.[3] ..... B41F 13/24; B41J 33/00

[52] U.S. Cl. ..... 101/170; 101/248; 101/350; 364/519

[58] Field of Search ..... 101/426, 170, 212, 350, 101/248; 364/469, 519

[56] References Cited

U.S. PATENT DOCUMENTS

| | | | |
|---|---|---|---|
| 2,802,666 | 8/1957 | Crosfield | 101/248 |
| 3,554,123 | 1/1971 | Lewallen | 101/170 |
| 3,567,923 | 3/1971 | Hutchison | 101/426 |
| 3,701,464 | 10/1972 | Crum | 101/248 |
| 3,915,090 | 10/1975 | Horst et al. | 101/426 |
| 3,958,509 | 5/1976 | Murray | 101/426 |
| 3,995,958 | 12/1976 | Pfahl et al. | 101/170 |
| 4,116,125 | 9/1978 | Forster et al. | 101/212 |
| 4,200,932 | 4/1980 | Schramm et al. | 364/519 |
| 4,233,663 | 11/1980 | Sugawara et al. | 101/170 |
| 4,318,176 | 3/1982 | Stratton et al. | 101/248 |

FOREIGN PATENT DOCUMENTS

| | | |
|---|---|---|
| 1001747 | 1/1957 | Fed. Rep. of Germany . |
| 2023467 | 11/1971 | Fed. Rep. of Germany . |
| 297052 | 3/1972 | Fed. Rep. of Germany . |

OTHER PUBLICATIONS

Heidelberg Offset CPC Brochure Published at Dupra, Jun. 3–16, 1977.

Der Polygraph (MAVO Article), 10/22/75, pp. 1393–1400 (translation included).

*Primary Examiner*—E. H. Eickholt

*Attorney, Agent, or Firm*—Leydig, Voit, Osann, Mayer & Holt, Ltd.

[57] ABSTRACT

An apparatus and method for checking and automatically correcting register adjustment of a sheet-fed printing press at the same time as remote densitometric measurement of an ink density check strip for ink fountain key adjustment. To read alignment marks printed parallel to the ink density check strip, a second optical sensor is mounted on the ink density scanner already used in practice to traverse and read the ink density check strip. A register control computer accepts the signal from the second optical sensor, detects the relative positions of the scanned alignment marks, compares the relative positions to each other and calculates axial, peripheral, and skew register adjustments. Position information is exchanged between the register control computer and the corresponding ink density control computer. The measured positions of the ink density check strip segments, for example, can be used in part to determine the positions of the register marks.

9 Claims, 8 Drawing Figures

METHOD FOR PRODUCTION OF IMPRESSIONS OF ACCURATE REGISTER ON PRINTING PRESSES

This invention relates to a method and apparatus for the production of high-quality multi-color printed sheets. Using known methods and apparatus, a sheet-fed printing press has ink fountain keys for adjusting the density of ink applied to the sheets and means for adjusting plate cylinder register so that the various colors on a multi-color sheet may be printed in exact register, one on top of the other.

To monitor the uniformity of the ink density, each sheet is printed with an ink density check strip which is scanned by an optical scanner. In practice, the scanning is usually performed at a control desk remote from the printing press. The control desk has a sheet support for receiving a test sheet and a traversing head having an optical sensor which scans across the check strip on the test sheet. The control desk may also have indicators and remote controls for adjusting the ink keys. Such a system is described, for example, in Schramm et al. U.S. Pat. No. 4,200,932 issued Apr. 29, 1980.

It is also known that the register of the plate cylinders in a multi-color printing press may be checked by printing register or alignment marks on the printed sheets. This is done, for example, by applying a mark of one color having a gap or tolerance range and printing a mark of another color within the gap or tolerance range of the first mark. This method is further disclosed in West German Patentschrift AT-PS 297052.

It is also known that the axial or side, peripheral or circumferential, and diagonal or skew register of a printing press may be controlled remotely from the press. But requiring the press operator to evaluate register marks and then to operate remote controls introduces the possibility of error and may limit the accuracy with which the register may be controlled.

The need for quick and accurate register adjustments is especially important in offset printing. In offset printing the ink impression is continuously displaced because of the use of a dampening solution in the printing process, and the need to wash the rubber blanket at regular intervals. The register displacements may occur suddenly, as in the case of washing the rubber blanket, or they may occur gradually because of variations in the temperature and the resulting change in ink viscosity.

The slightest stretching or shrinkage of the sheets also causes a displacement in the printed ink but this displacement should be distinguished from the displacement caused by register adjustment.

A general aim of the invention is to provide automatic measurement and control of register accuracy in the multi-color printing process.

Another object of the invention is to provide a method of automatic measurement and control of register adjustment that requires no additional set-up time and minimal additional hardware when used with an ink density control desk, thereby providing quick and inexpensive automatic register adjustment.

Yet another object is to provide a method of automatic control of register adjustment which discriminates register errors from paper shrinkage.

Still another object is to provide a method whereby measured values obtained by scanning the ink density check strip can be used to adjust the measured positions of the register or alignment marks determined by scanning the register or alignment marks.

In accordance with the present invention, a second optical sensor is added to the ink density scanner of a remote control desk. The printing plates are manufactured with a set or line of alignment marks parallel to the ink density check strip, so that the alignment marks are sensed by the additional optical sensor when the ink density scanner traverses a printed test sheet placed on the sheet support of the control desk. A register control computer is provided for evaluating the signal from the additional optical sensor to detect the relative positions of the alignment marks and for generating register adjustment values from the detected relative positions. Thus the scanning and computation of register adjustment values occur at the same time that the ink density strip is scanned so that there is no additional time involved for register adjustment. Hence, automatic register adjustment can be provided at reasonable cost as a by-product or additional feature of a control desk for ink density adjustment. Since ink density values are available to the register control computer, they may also be used in the determination of register adjustment in addition to the measured values of the register or alignment marks. Moreover, the register control computer and the corresponding ink control computer can exchange relative position information thus simplifying the determination of relative position. The positions of the segments of the ink density check strip provide an additional measure of register position which can be used to more accurately discriminate paper shrinkage from register error. Additional flexibility of the measurement and control system is provided by means for inputing register set-up values and ink density set points, and adjustably mounting the additional optical sensor to the ink density scanning head.

Other objects and advantages of the invention will become apparent upon reading the following detailed description and upon reference to the drawings in which.

Figure 1:
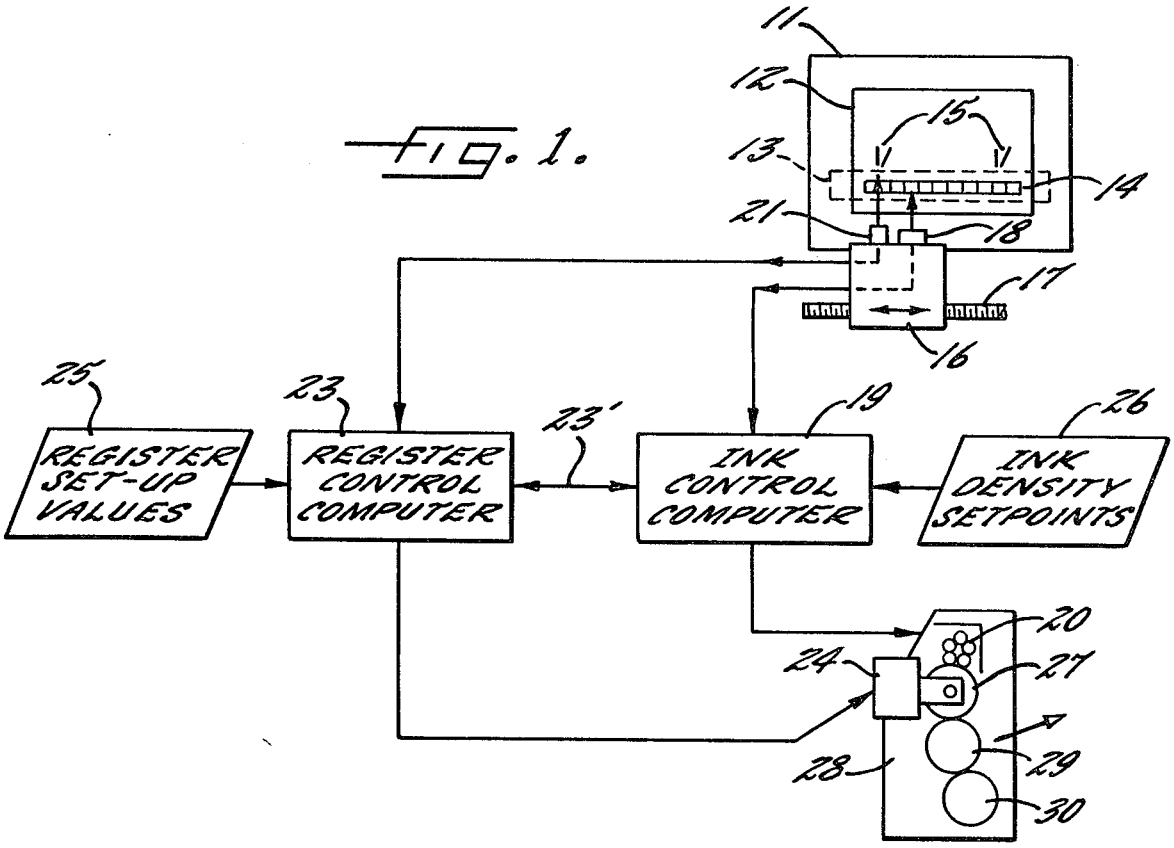
FIG. 1 is a schematic diagram of the invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

Turning now the drawings, there is shown in FIG. 1 a sheet support 11 on a control desk or checking table which receives a test sheet 12 held in a fixed position by a suction bar 13. The test sheet has a traversely printed ink density check strip 14, and several register or alignment marks 15. A scanning or traversing head 16 is mounted above the surface of the sheet support 11 on a threaded drive shaft or spindle 17. The traversing head 16 has an optical densitometer sensor 18 focused on and driven across the length of the ink density check strip 14 for the determination of the density or impression of the various colors of ink applied by the printing press. The sensor 18 generates a signal fed to an ink control computer 19 which evaluates the signal to obtain measured ink density values. After receiving ink density set points 26 from a computer terminal or input manned by the press operator, the ink control computer generates ink density adjustment values. The ink density adjustment values are conveyed to a means 20 for adjusting the density of ink applied to the sheets, which in practice comprises servo driven ink keys or other ink flow regulating devices.

In accordance with the invention, a line or set of alignment or register marks 15 is printed transversely across the sheet 12 parallel to the ink density check strip 14. An additional or second optical sensor 21 mounted on the traversing head 16 is aligned with and focuses upon the alignment marks 15. Thus, the alignment marks and the ink density strip are scanned at the same time as the head 16 traverses the sheet. In interpreting the appended claims, the terms "scanned at the same time" merely mean that the two optical sensors 18, 21 move together across the sheet, regardless of whether the actual respective signals from the sensors 18, 21 are generated simultaneously or at different time intervals. The signal from this second optical sensor 21 is fed to a register control computer 23 which evaluates the signal to detect the relative positions of the scanned alignment marks and inputs register set-up values 25 from the press operator. The register control computer 23 also has a connection or link 23' comprising means for exchanging scanning and relative position information with the ink control computer 19. From the relative positions and the set-up values, the register control computer 23 calculates register adjustment values which are fed to known register control devices 24 for adjusting the plate cylinder 27 axial or side, peripheral or circumferential, and diagonal or skew register. The printing press 28 as shown also has a blanket cylinder 29 cooperating with the adjusted plate cylinder 27 and an impression cylinder 30.

Figure 2:
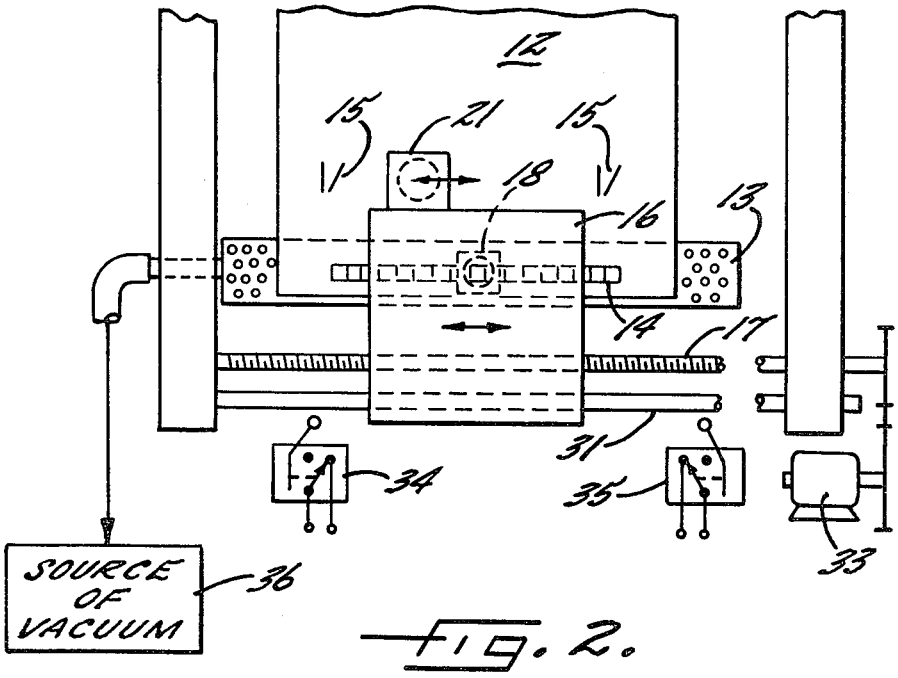
FIG. 2 is a pictorial diagram of the scanning head and associated components on the control desk, showing the adjustable mounting of the additional optical sensor.

FIG. 2 shows the scanning head 16 and associated components in more detail. The scanning head 16 is slidably mounted on a bar 31 for steady transverse motion as it is driven by the threaded shaft or spindle 7. The shaft 7 is driven by a reversible stepper or synchronous motor 33. End of travel of the scanning head 16 is detected by limit switches 34 and 35. The optical scanner 21 sensing the register or alignment marks 15 is adjustably mounted on the scanning head 16 so that the offset between the densitometer scanner 18 and the alignment scanner 21 is variable. The source of vacuum 36 to the suction bar 13 is also depicted in FIG. 2.

Figure 3:
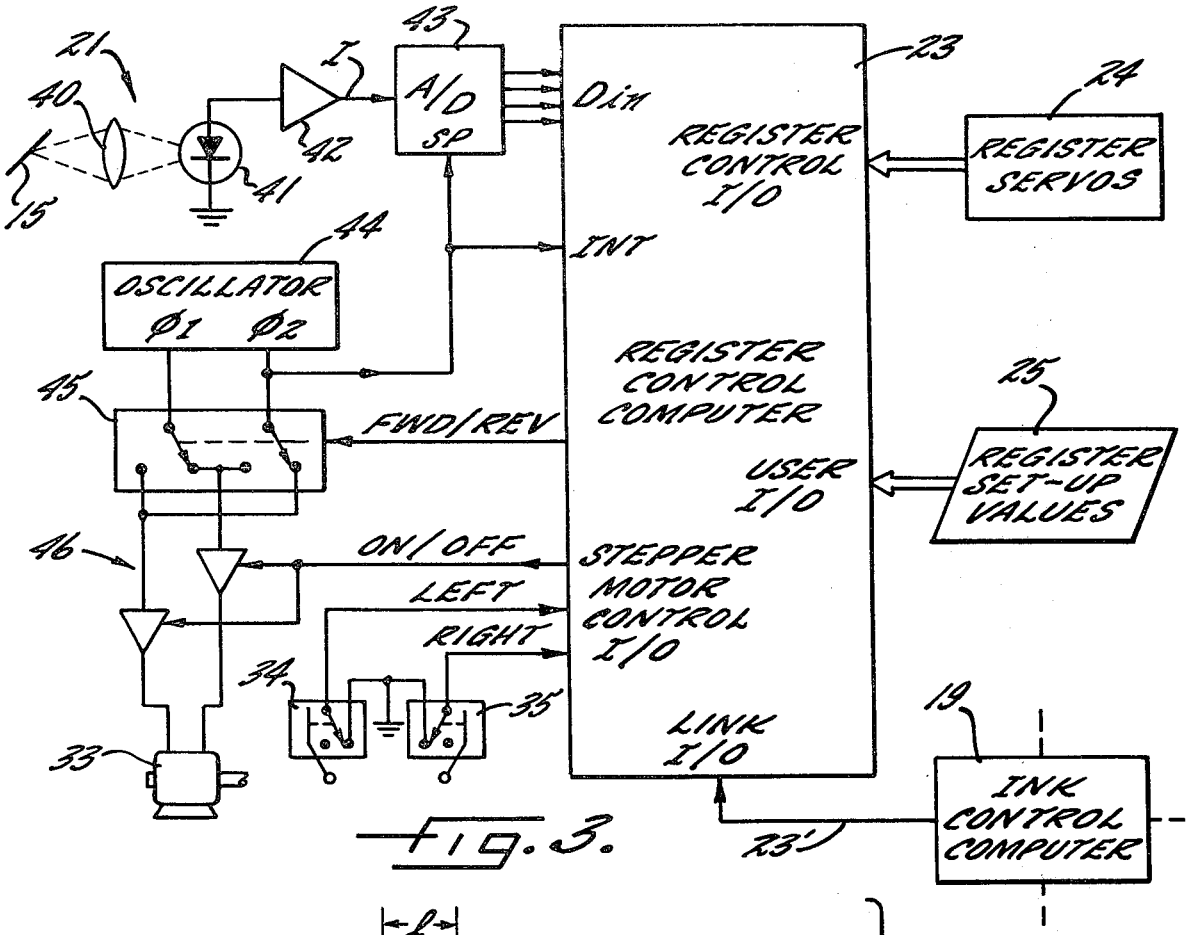
FIG. 3 is a schematic diagram of an exemplary register control computer and interconnected electrical components.

A particular embodiment of the register control computer and associated electrical components is shown in FIG. 3. The register control computer 23 is shown as a distinct microprocessor or controller separate from the ink control computer 19, but it will become evident to persons skilled in the art that the register control computer and the ink control computer could be embodied in a single microprocessor or numerical control computer.

The primary input to the register control computer 23 is the signal from the alignment mark sensing scanner generally designated 21 having a lens 40 which focuses an image of the register or alignment mark 15 on a photodetector such as a photodiode 41. The signal from the photodiode 41 is amplified by a preamplifier 42 and digitized by an analog-to-digital converter 43 to generate a numerical measured value on a parallel set of binary inputs $D_{in}$ of the register control computer 23. The timing or sampling for the analog-to-digital converter 43 is provided by an oscillator or clock 44 generating a signal applied to the sampling input SP of the analog-to-digital converter 43 and also applied to an interrupt input INT of the register control computer 23. The oscillator 44 has multiple phases $\phi_1$, $\phi_2$ which may be selected by a multiplexer 45 in response to a FORWARD/REV. signal from the register control computer and amplified by drivers 46 to control the stepper motor 33. The drivers 46 are enabled by an ON/OFF signal from the register control computer 23. The register control computer also accepts LEFT and RIGHT input signals from the limit switches 34, 35 respectively which detect the limit of travel of the traversing head 16. The register control computer also has input/output or I/O ports for register control, for accepting register set-up values from the user or press operator, and for exchanging information between the register control computer 43 and the ink control computer 19 via the LINK I/O port.

Figure 4:
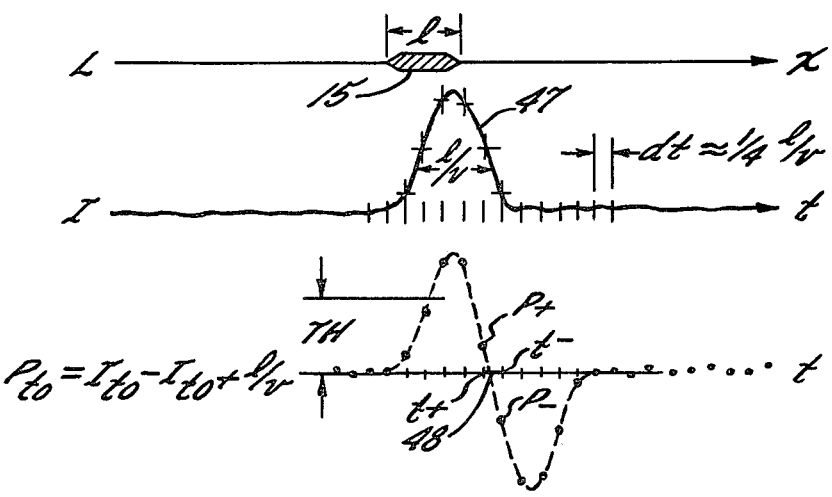
FIG. 4 is a timing diagram for a preferred alignment or register mark detection procedure.

The two main functions performed by the register control computer 23 are to evaluate the signal from the register optical sensor 21 to detect the relative positions of the scanned alignment marks 15, and to generate register adjustment values from the detected relative positions. The register control computer 23 preferably performs the position detecting function according to a procedure illustrated in FIG. 4. The actual optical signal L is a function of displacement x, with the register or alignment mark having a width l. The optical sensor 21 converts the light L to an electrical signal I which is a function of time t and which is filtered and band limited by the preamplifier 42 for noise rejection. As shown in FIG. 4, a pulse 47 of width l/v is generated having a maxima at approximately the trailing edge of the alignment mark 15, illustrating the delay associated with the low pass filter in the preamplifier 42. The register control computer 23 must evaluate the electrical signal I to detect the position of the alignment mark 15, and preferably the method of detecting position is insensitive to the width l of the alignment mark 15, the ambient illumination level, and the ink density of the alignment mark 15. A simple method of position detecting is to compare the signal I to a predetermined threshold, but this method is not independent of the width l, ambient illumination, or ink density.

In order to detect the position of the alignment mark 15, preferably the signal I is sampled by the analog-to-digital converter 43 so that the signal I is approximated by the time series of samples. As shown in FIG. 4, the sampling interval dt is one quarter l/v. Then the register control computer 23 may execute a digital filter procedure to select the position information inherent in the optical sensor signal I. An exemplary digital filter is "tuned in" to the predominant spatial frequency of the alignment mark 15 by computing the difference between the current sample $I_{t0}$ and the previous sample $I_{t0+l/v}$ occurring four sample intervals previously, this time delay being the time for the optical sensor 21 to traverse the width l of the alignment mark 15. The position of the alignment mark 15 then becomes the time at the effective zero crossing 48 of the digital filter output $P_{t0}$. The zero crossing 48 may be determined by linearly interpolating between the samples P+ and P− at times t+ and t− and having opposite polarities or signs. This detection procedure will be further shown and described in conjunction with FIG. 8.

Figure 5:
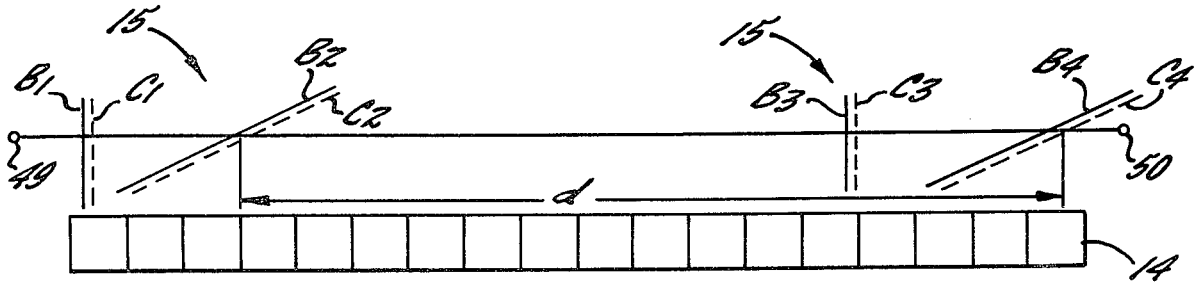
FIG. 5 is an expanded view of one particular format for the alignment marks and an ink density check strip printed on the sheets.

The second function of the register control computer is to calculate register adjustment values from the detected relative positions of the alignment marks 15. An exemplary format for the alignment marks is shown in FIG. 5. For the sake of a specific example, it is assumed that only two distinct colors are printed, denoted B for black and C for a primary color. The alignment marks or lines 15 are scanned along the path or traverse line from an initial left-hand point 49 to a final right-hand point 50. The measured relative positions of the particular alignment lines (denoted B1, C1, . . . B4, C4) are the traverse displacements of the respective points of intersection of the alignment lines with the scan line 49–50 from the initial point 49.

As shown, the primary color marks are offset from the black marks in a predetermined fashion by a precise amount so that the register control computer can associate the relative positions with the respective colors by the order in which the individual alignment lines are scanned. Since it is assumed that a predetermined offset HOFF between adjacent alignment lines of different colors is precisely etched on the printing plates, it may be subtracted from the measured offsets to calculate the offset due to register adjustment error or paper shrinkage. Then, for example, any deviation of the distance C1-B1 from the offset HOFF indicates an axial register error or paper shrinkage. The deviation in the scanned positions of the diagonal alignment marks B2 and C2, on the other hand, will have measured relative positions affected by both the axial deviation and the peripheral deviation, so that the peripheral deviation may be determined by subtracting the offset HOFF and the axial deviation from the measured distance C2-B2. These calculations, however, are only approximate since the effect of a diagonal or skew register error must be taken into account. To detect skew, alignment marks 15 are printed on both the left and right portions of the sheet 12. Then the axial deviation is calculated as the average of the axial deviations for the left-hand and right-hand pairs of alignment marks. Similarly, the peripheral deviation is calculated as the average of the peripheral deviations for the left-hand and right-hand pairs of alignment marks. The diagonal or skew deviation is related to the difference between the peripheral deviation for the left-hand marks and the peripheral deviation for the right-hand marks. Moreover, the difference between the axial deviation for the left-hand marks and the right-hand marks is related to paper shrinkage during the time that the paper moves between the impression cylinders for the different colors. Another measure of paper shrinkage is obtained by comparing the distance d between respective left-hand marks and right-hand marks. Moreover, this distance d can be compared to corresponding distances between particular colored segments of the ink density strip 14 for a further indication of paper shrinkage. Particular examples of these calculations will be further described in conjunction with FIG. 7.

Figure 6:
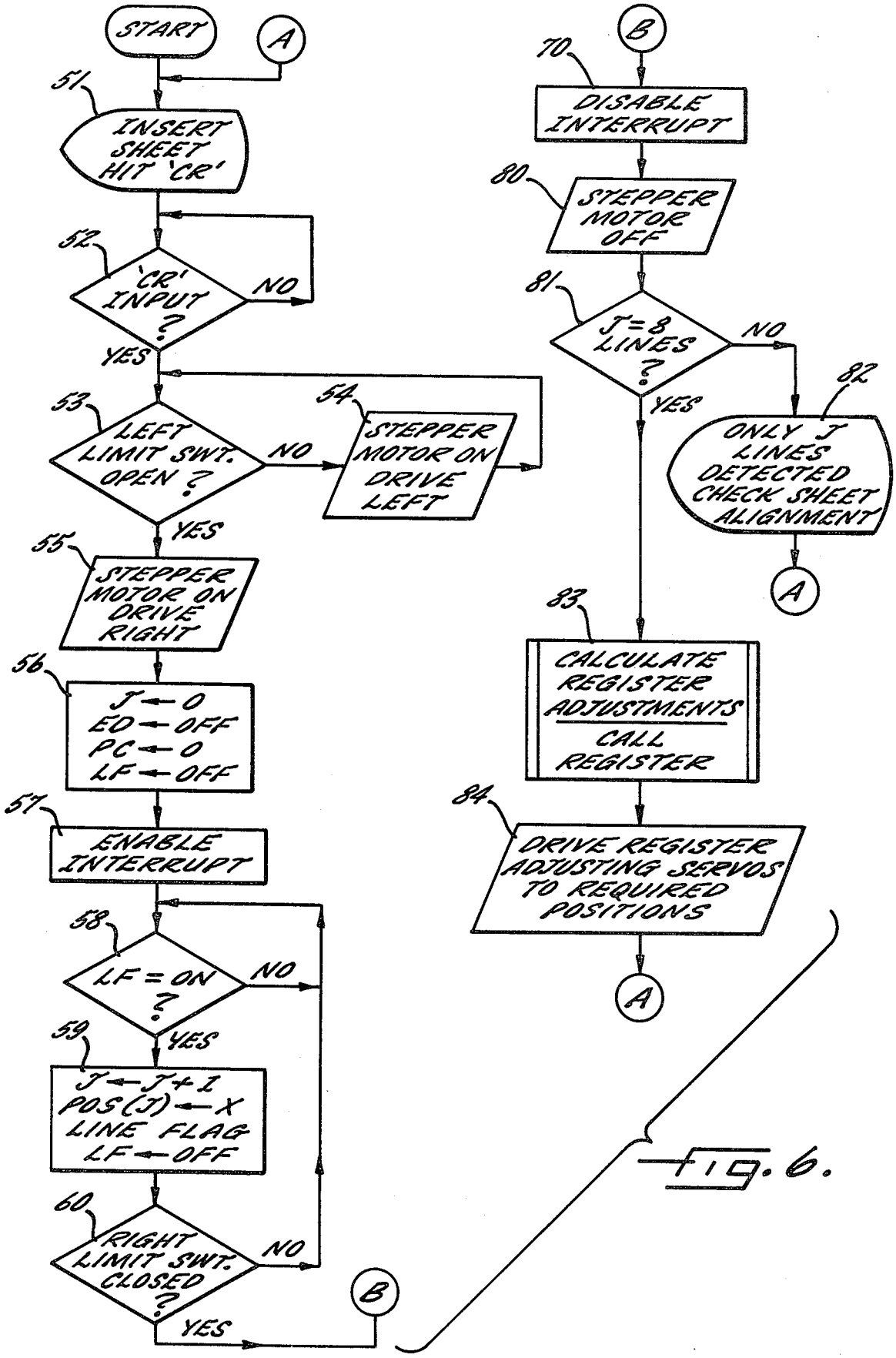
FIG. 6 is a flowchart for an executive procedure executed by the register control computer.
Figure 7:
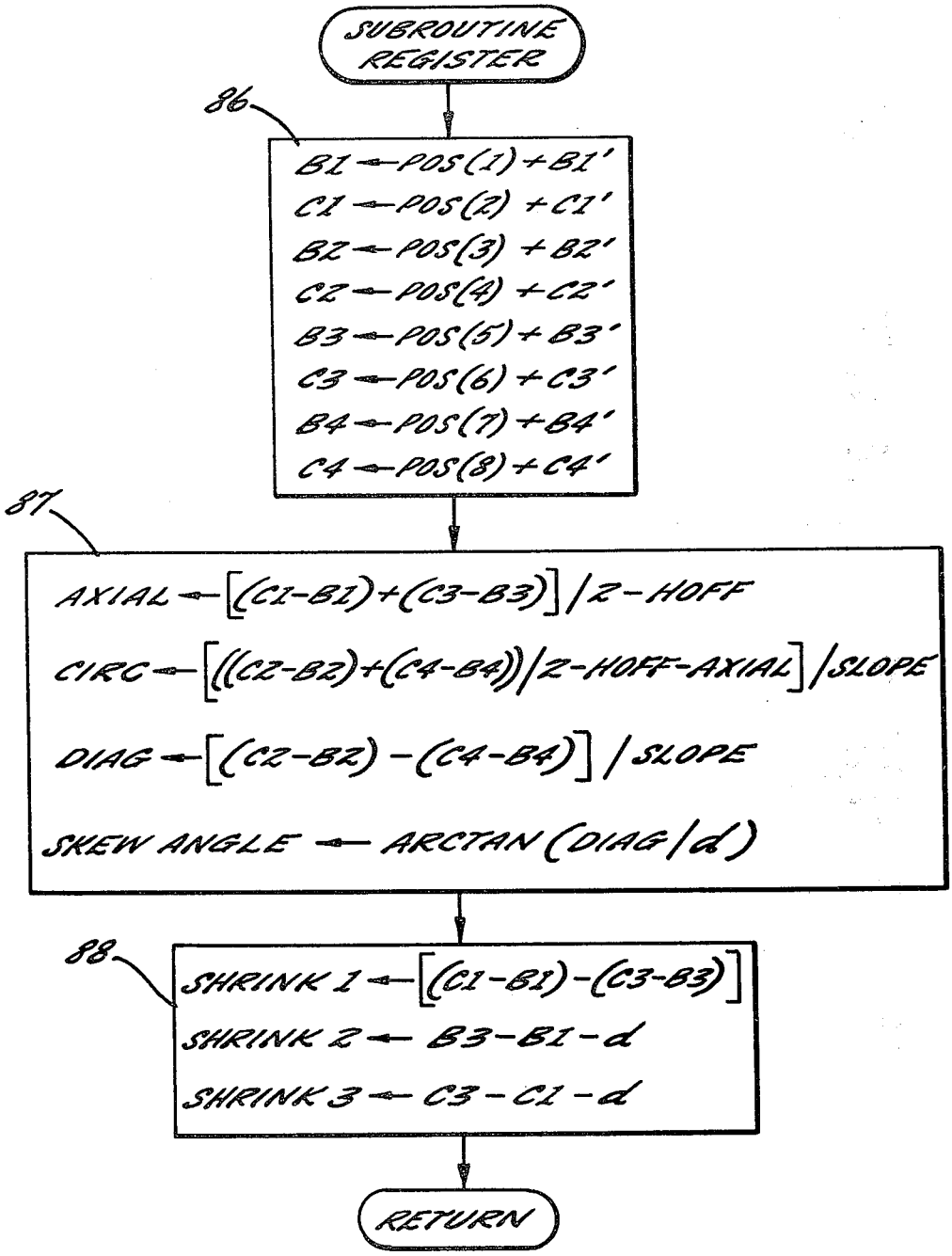
FIG. 7 is a flowchart of a subroutine that calculates register adjustments from the measured positions of register or alignment marks printed according to the format of FIG. 5.
Figure 8:
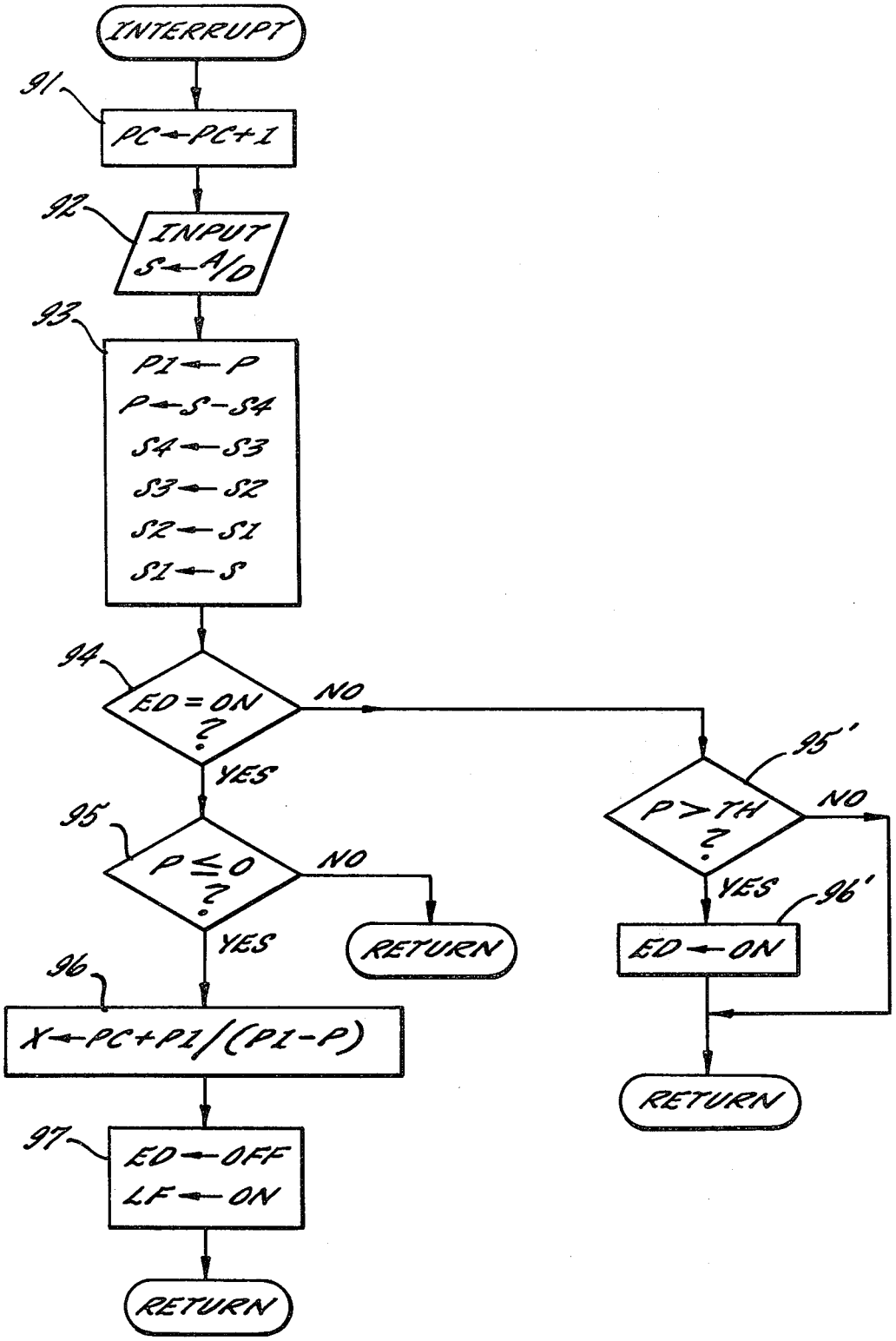
FIG. 8 is a flowchart of an interrupt procedure which actually detects the relative positions of the alignment or register marks according to the procedure depicted in FIG. 4.

The register control computer performs its assigned functions by executing a procedure or series of instructions stored in its memory. Flowcharts for an exemplary procedure are shown in FIGS. 6–8. The register control computer starts executing the executive procedure of FIG. 6 upon a power-on or user activated reset. The register control computer responds in step 51 by instructing the press operator to place a test sheet on the checking table 11. The computer then checks for a carriage return in step 52 to determine whether a sheet has been inserted. It is understood that the register control computer 23 is interfaced at the USER I/O port to an input or computer terminal (not shown) receiving the register set-up values 26 and displaying the indicated messages to the user or press operator. In step 53 the computer checks whether the left limit switch 34 is open, and if it is not the stepper motor 33 is turned on and driven to the left in step 54 to bring the scanning head 16 to an initial far left-hand position. Then the stepper motor is turned on in step 55 and driven to the right for the scanning of the alignment marks and the ink density check strip.

In step 56 the position sensing and detecting procedures are initialized by setting several pointers and flags to initial values. The position array index or alignment mark pointer J is set to zero and the edge detect flag ED is set off. Also the position counter PC is set to zero and the line flag LF is set off. The edge detect flag ED indicates whether the register optical sensor 41 has sensed the leading edge of an alignment mark. The position counter PC detects the number of steps which the stepper motor 33 has been driven from the initial left-hand position or point 49 in FIG. 5. The line flag LF indicates whether the position of an alignment mark 15 has just been determined. The functions of these pointers, counters, and flags will become clear in the following description.

In step 57 the interrupt is enabled so that the interrupt routine in FIG. 8 will increment the position counter PC in response to stepper motor steps and will start evaluating the signal from the register optical sensor 41 in order to detect the positions of the alignment marks. Then in step 58 the line flag LF is tested to determine whether it is on. If it is on, then the interrupt routine of FIG. 8 has detected the position of an alignment mark and consequently in step 59 the alignment mark pointer J is incremented, and the relative position X is calculated by the interrupt routine and temporarily stored in a position array POS(J). Then the line flag LF is set off in order to enable the detection of more alignment marks. But the right limit switch 35 is tested in step 60 to determine whether a complete scan has occurred before execution returns to step 58 to accept more line positions. If the right limit switch is closed and thus canning is complete, the interrupt is disabled in step 70 and the stepper motor is turned off in step 80.

At this point all of the lines have been scanned and thus the number of detected lines is tested in step 81 to make certain that the register control computer has sensed all of the alignment lines. In the particular example of FIG. 5, there are eight lines and thus in step 81 the line pointer J is compared to eight and if some of the lines are not detected, a message is displayed to the operator in step 82 and the executive procedure is restarted. This might be necessary, for example, if the printing press failed to reproduce all of the alignment marks on the test sheet or if the test sheet was improperly aligned on the checking table 11.

If all eight of the alingment lines were detected, the register control computer in step 83 calls a subroutine REGISTER to calculate the register adjustments from the positions stored in the position array (POS(J). Finally in step 84 the register adjustment servos 24 are driven to the required positions in order to eliminate register error, according to the register adjustments calculated in Step 83. It will become obvious to persons skilled in the art that alternatively the adjustment values for a number of tests sheets could be determined and averaged before the register servos are adjusted, in order to reduce statistical errors.

The REGISTER subroutine is shown in FIG. 7. In step 86 the relative positions of the register marks stored in the POS(J) array are interpreted as the positions of the register marks of various colors. Moreover, the relative positions in the POS(J) array are shown adjusted by respective correction terms B1'–C4' depending on the ink densities determined by the ink control computer 19. These correction terms B1'–C4' are relatively small values generally proportional to the measured ink density values, and they supplement the detection procedure shown in FIG. 4, or alternatively a simple threshold detection procedure, by reducing any error caused by variable ink density. Thus, correction of measured position as a function of ink density is one optional method wherein the measured values obtained by scanning the ink density check strip are used in the determination of the control values for register adjustment from the measured values obtained by scanning the alignment marks. It should also be noted that the measured values obtained by scanning the ink density check strip could be used in the process of identifying the position values in the array POS(J) with the various primary colors. In such a variable alignment mark format, the order and number of colored alignment marks could be determined by the order and number of colors in the individual segments of the ink density check strip 14. It should also be noted that relative position information in terms of the value of the position counter PC preferably is exchanged over the LINK I/O port interconnecting the register control computer and the ink control computer, as well as register mark position or ink density values. Then the ink control computer need to spend time controlling or determining the position of the traversing head 16. Alternatively, the ink control computer 19 could control and measure the position of the traversing head, and pass the position information to the register control computer.

Once the relative positions of the alignments marks of the various colors have been determined, the axial, peripheral, and diagonal or skew adjustments are calculated in step 87. For calculating the axial and peripheral register errors, the horizontal offset HOFF of the alignment marks must be known. This offset HOFF may be a predetermined stored constant, or it may be a register set-up value received from the press operator as an input 25.

Other register set-up values could specify the number of alignment marks and their format. Moreover, in some situations it is desirable for a single checking table or control desk to adjust the register for a number of printing presses, and hence the particular press which printed the test sheet could also be a register set-up value specifying the particular register servos 24 to be adjusted by the register control computer 23. Still other predetermined values which may be register set-up values include the slope of the diagonal register marks and the distance d between corresponding right and left-hand alignment marks when the marks were etched on the printing plates. Depending on the particular servo mechanism 24 or means for adjusting the register, the actual register positions used in printing the test sheet could be set-up values, from which new adjustment value positions could be calculated by comparison to the measured values of the register errors or adjustment values.

In step 87 the axial register error AXIAL is calculated as the average horizontal offset of the vertical alignment lines B1, C1, and B3, C3 less the horizontal offset HOFF. By taking the average, the effect of paper shrinkage is discounted. Similarly, the circumferential or peripheral register error CIRC is calculated as the average of the horizontal displacements of the diagonal alignment lines B2, C2 and B4, C4 less the horizontal offset HOFF less the previously calculated axial register error AXIAL, which then must be divided by the slope SLOPE to transform the horizontal offset to the vertical register deviation. It should be noted, then, that the measured peripheral error CIRC becomes more independent of the axial register error AXIAL for smaller slopes or as the diagonal register lines becomes more parallel to the horizontal scan line 49–50. The diagonal or skew error is calculated as the difference between the horizontal offsets between the respective pairs of diagonal alignment marks B2, C2 and C4, B4, divided by the slope SLOPE. Again, a small slope will insure that the diagonal register error DIAG is relatively independent of paper shrinkage. Note that the horizontal offset HOFF and axial error AXIAL are effectively eliminated from the calculation of the diagonal register error DIAG. The diagonal error DIAG may be expressed as a dimensionless SKEW ANGLE parameter calculated as the arctangent of the diagonal error DIAG divided by the distance d between the left and right hand sets of register marks.

In step 88, paper shrinkage is estimated as the difference between the right-hand and left-hand axial register errors C1-B1 and C3-B3. This estimate SHRINK1 is a measure of the paper shrinkage between the application of the black and primary color register marks. Other measures of paper shrinkage may be calculated by comparing the actual differences B3-B1 and C3-C1 between respective left-hand and right-hand register marks with the predetermined distance d between the etched marks on the printing plates. These measures of paper shrinkage SHRINK2 and SHRINK3 actually measure the shrinkage from the time that the respective alignment marks are printed on the test sheet to the time that the test sheet is scanned on the test table or control desk 11. Other shrinkage factors could be determined by comparing distances between segments of the ink density scanning strip 14 as determined by the ink control computer 19 from the measured values obtained by scanning the ink density check strip to the measured relative distances between corresponding pairs of alignments marks determined by the register control computer 23.

The actual evaluating of the signal from the register optical sensor 21 is performed by the register control computer 23 executing an interrupt routine, as shown in FIG. 8. Upon detection of a transition of the oscillator 44 phase $\phi_2$ on the interrupt input INT, the position counter PC in incremented in step 91. Then in step 92 the numeric value of the analog-to-digital converter output on the input port $D_{in}$ of the register control computer 23 is read into a temporary storage location S. In step 93, digital filtering on the sample S is performed by first storing the previous digital filter output P in a storage location P1 and then calculating the new value of the digital filter output P as the difference between the current sample S and the value S4 denoting the fourth prior sample of S. The fourth prior sample S4 is obtained from a first-in-first-out stack having temporary storage locations S4, S3, S2, and S1.

The actual position detection procedure starts with step 94 which tests the edge detect flag ED to determine whether the register control computer should be looking for the leading edge of an alignment mark or whether it should be looking for the effective zero crossing 48 as depicted in FIG. 4. If the edge detect flag ED is off, then in step 94' the register control computer looks for the leading edge by comparing the digital filter output P to a predetermined threshold TH. The threshold TH should be a function of the ambient illumination as suggested by FIG. 4, and it could be determined from the measured ink density values from the densitomer sensor 18 or from measured values of previous or initial alignment marks 15. If the digital filter value P is greater than the threshold TH, then the leading edge has been detected and the edge detect flag ED is set on in step 96'. Otherwise, the interrupt routine has completed its execution for the current A/D sample S. If the edge detect flag ED is on in step 94, then in step 95 the register control computer must look for the zero crossing 48 by comparing the digital filter value P to zero. If the digital filter value P is greater than zero, then the interrupt routine has finished its processing for the current A/D sample S. Otherwise, the current digital filter sample P is less than or equal to zero, corresponding to P− in FIG. 4, while the previously stored digital filter sample P1 corresponds to P+ in FIG. 4. Thus the relative position of the zero crossing 48 may be calculated in step 96 as the current value of the position counter PC plus a linear interpolation fraction of P1/(P1-P). It should be noted that by linear interpolation, the relative position is known to much greater precision than a single step of the stepper motor 33. But only the relative position is known since there may be some error in the start-up of the stepper motor 33 and the initial opening of the left limit switch 34. The absolute position, however, is irrelevant when differences between relative position are calculated, as in all of the register errors calculated in step 87 or the paper shrinkage values in step 88 of FIG. 7. Finally, in step 97 the edge detect flag ED is set off, and the line flag LF is set on to tell the executive procedure in step 58 (FIG. 6) that a line position X has been calculated. This completes the description of the procedures executed by the register control computer 23.

From the foregoing, it can be seen that by adding an optical sensor to an existing ink density scanner on a control desk and by interfacing the ink density scanner to a suitably configured register control computer, the register of a multi-color printing press may be quickly and accurately controlled automatically when an ink density check strip is scanned at the control desk. Moreover, position and measured ink density values may be exchanged between the register control computer and the ink control computer in order to simplify the determination of relative position of the optical scanners and to more precisely measure the relative positions of the alignment marks. Axial, circumferential or peripheral, and diagonal or skew register errors, and paper shrinkage can be independently ascertained and the register errors automatically corrected by the apparatus and method according to the invention.

What is claimed is:

1. A method for the production of high-quality multicolored printed sheets, the printed sheets being printed in a printing press having means for adjusting the density of ink applied to the sheets and means for adjusting plate cylinder register, the method comprising the steps of:

printing an ink density check strip on the sheets characterizing the density of ink applied to the sheets, printing at least one alignment mark on the sheets characterizing the positional accuracy of the application of ink by the printing press, the alignment mark being printed at the same time that the ink density check strip is printed, thereafter scanning the alignment mark and the ink density strip at the same time, determining therefrom respective register alignment measured values and ink density measured values at the same time, and determining control values for register and ink density adjustment at the same time from the register alignment and ink density measured values.

2. The method of claim 1 wherein the step of scanning the alignment mark and the ink density strip at the same time comprises the steps of placing the sheet to be scanned on a sheet support, traversing the sheet with a scanning head mounted to the sheet support and supported above the sheet, and generating scanning signals from first and second optical sensors mounted on the scanning head and aligned to sense the ink density check strip and alignment mark respectively.

3. The method of claim 2 wherein the locations on the sheet scanned by the first optical sensor are adjacent and longitudinally offset from the locations on the sheet scanned by the second optical sensor.

4. The method of claim 1 wherein the values obtained by scanning the ink density check strip are also used in the determination of the control values for register adjustment in addition to the measured values obtained by scanning the alignment marks.

5. The method of claim 1, 2, 3 or 4 further comprising the step of accepting a required register set-up value from the press operator, and wherein the step of determining control values for register and ink density adjustment comprises the step of comparing the required register set-up value to a corresponding actual register adjustment value to determine a register control value.

6. An apparatus for determining ink density adjustment values and register adjustment values for adjustment of ink fountain keys and register adjusting devices of a printing press by scanning a printed sheet remote from the printing press, the printed sheet having an ink density check strip and alignment marks traversely printed thereon, comprising, in combination, a sheet support for receiving the printed sheet, a traversing head mounted above the sheet support and means for driving the traversing head traversely across the printed sheet, a first optical sensor mounted on the traversing head for scanning the ink density check strip printed on the sheet, ink control computer means for evaluating the signal from the first optical sensor to obtain measured ink density values and for generating ink density adjustment values by comparing the measured ink density values with ink density setpoints, a second optical sensor mounted on the traversing head for scanning the alignment marks printed on the sheet, and register control computer means for evaluating the signal from the second optical sensor to detect the relative positions of the alignment marks and for generating register adjustment values from the detected relative positions, so that automatic register control is effected at the same time as ink key adjustment.

7. The combination as claimed in claim 6 wherein the printed sheet has printed thereon a traverse line of alignment marks parallel and adjacent to the ink density check strip, and wherein the second optical sensor is adjustably mounted adjacent to and offset from the first optical sensor, so that the traverse line of alignment marks is scanned coincident with the scanning of the ink density strip.

8. The combination as claimed in claim 6, wherein the register control computer means has means for receiving a set-up value from the press operator and means for computing a corresponding measured value from the positions of the alignment lines and comparing the set-up value to the corresponding measured value to determine a corresponding register adjustment value.

9. The combination as claimed in claim 6 or claim 7 further comprising means for exchanging scanning and relative position information between the ink control computer means and the register control computer means.

* * * * *